US011506218B2

(12) United States Patent
Qiu et al.

(10) Patent No.: US 11,506,218 B2
(45) Date of Patent: Nov. 22, 2022

(54) METHOD FOR OPTIMIZING BLADE AXIS POSITION OF WATER PUMP UNDER ALL OPERATING CONDITIONS

(71) Applicant: YANGZHOU UNIVERSITY, Yangzhou (CN)

(72) Inventors: Baoyun Qiu, Yangzhou (CN); Kaiming Wu, Yangzhou (CN); Di Liu, Yangzhou (CN); Jinyu Cao, Yangzhou (CN); Cai Zhang, Yangzhou (CN); Chenglong Xue, Yangzhou (CN); Mengfan Xu, Yangzhou (CN)

(73) Assignee: YANGZHOU UNIVERSITY, Yangzhou (CN)

( * ) Notice: Subject to any disclaimer, the term of this patent is extended or adjusted under 35 U.S.C. 154(b) by 994 days.

(21) Appl. No.: 16/240,494

(22) Filed: Jan. 4, 2019

(65) Prior Publication Data

US 2019/0154040 A1 May 23, 2019

(30) Foreign Application Priority Data

Jan. 5, 2018 (CN) ..... 201810009782.3

(51) Int. Cl.

| | |
|---|---|
| ***F04D 29/18*** | (2006.01) |
| ***F04D 3/00*** | (2006.01) |
| ***F04D 29/00*** | (2006.01) |

(52) U.S. Cl.

CPC ..... *F04D 29/18* (2013.01); *F04D 3/00* (2013.01); *F04D 29/007* (2013.01)

(58) Field of Classification Search

CPC ..... F04D 3/00; F04D 29/007; F04D 29/18; G06F 30/10; G06F 2219/06; G06F 2119/06

See application file for complete search history.

(56) References Cited

U.S. PATENT DOCUMENTS

2012/0082543 A1* 4/2012 Choudhuri ..... F04D 3/00 415/211.2

* cited by examiner

*Primary Examiner* — Richard A Edgar
*Assistant Examiner* — Jason G Davis
(74) *Attorney, Agent, or Firm* — CBM Patent Consulting, LLC

(57) ABSTRACT

A method for optimizing the blade axis position of a water pump under all operating conditions which includes determination of multiple calculation conditions within the range of all the operating conditions of the water pump, three-dimensional modeling and mesh generation of the calculation area of the flow field of the water pump at multiple blade angles, numerical simulation of the flow field and calculation and determination of blade hydraulic torques under multiple conditions, determination of the range of the position of the blade resultant hydraulic pressure action line and an optimal blade axis position under all the operating conditions, determination of the small region of the optimal blade axis position under all the operating conditions, determination of the optimal blade axis position, and comparison of the blade hydraulic torques before and after optimization of the blade axis position.

1 Claim, 5 Drawing Sheets

METHOD FOR OPTIMIZING BLADE AXIS POSITION OF WATER PUMP UNDER ALL OPERATING CONDITIONS

This application claims priority to Chinese Patent Application Ser. No. CN201810009782.3 filed on 5 Jan. 2018.

TECHNICAL FIELD

The invention belongs to the technical field of reliability and durability of power mechanical equipment, relates to a method for optimizing a blade axis position of a full-adjustable water pump under all operating conditions, and particularly relates to a blade axis position optimizing method for minimizing the maximum blade hydraulic torque of a water pump under all the operating conditions at different heads and different blade angles.

BACKGROUND ART

Axial-flow pumps and guide vane mixed-flow pumps are mainly used in fields like agricultural irrigation and drainage, water diversion, sewage treatment, thermal power generation, ship industry and nuclear power, but their high-efficiency areas are narrow, when the water level or head of a pump station changes and deviates from the rated condition, operation efficiency is low, and vibration and overload tend to occur, affecting efficient and safe operation. By arranging a blade full-adjustment mechanism, blade angle adjustment of large and medium-sized axial-flow pumps and guide vane mixed-flow pumps is achieved, so as to realize variable-angle optimized operation, adjust the flow rate, save the operation cost and improve the reliability and durability of the pump unit. There are two types of blade full-adjustment mechanisms, a mechanical type and a hydraulic type, but at present, the blade adjustment force of a axial-flow pump is generally large, especially the blade adjustment force which fails to take into account of all operating conditions of the axial-flow pump, resulting in large stress, serious deformation, large angle adjustment error and easy damage to a release bearing for mechanical blade full-adjustment mechanisms, and high adjustment-required oil pressure and high possibility of seal failure for hydraulic blade full-adjustment mechanisms, leading to oil leakage and angle adjustment failure. Calculation and research show that the blade adjustment force of a axial-flow pump is mainly composed of a hydraulic torque on the blade axis caused by the action of axial-flow flow on a blade during operation. Therefore, it is necessary to design a blade with the smallest blade hydraulic torque under all the operating conditions on the premise of ensuring or not changing the hydraulic performance of an impeller, so as to reduce the blade adjustment force and improve the angle adjustment accuracy as well as reliability and durability of an adjustment mechanism.

SUMMARY OF THE INVENTION

The purpose of the invention is to solve the problem that the blade hydraulic torque of large and medium-sized full-adjustable axial-flow pumps and guide vane mixed-flow pumps is too large, and to provide a method for optimizing a blade axis position of an axial-flow pump under all operating conditions, the surface pressure distribution and the hydraulic torque of an impeller blade are calculated by using computational fluid dynamics-CFD flow field calculation software, and the position of a blade axis in the water flow inlet and outlet direction of the blade is adjusted and optimized through analysis, so that the blade hydraulic torque of the axial-flow pump under all operating conditions is reduced, and the purpose of reducing the adjustment force is achieved.

According to the technical scheme of the invention, a method for optimizing the blade axis position of a axial-flow pump under all operating conditions is characterized by including the following operation steps:

A. determination of calculation conditions within the range of all the operating conditions of the axial-flow pump;

B. three-dimensional modeling and mesh generation of the calculation area of the flow field of the axial-flow pump;

C. numerical simulation of the flow field of the axial-flow pump and calculation and determination of the blade hydraulic torque;

D. determination of the range of the position of the blade resultant hydraulic pressure action line of the axial-flow pump and the optimal blade axis position under all the operating conditions;

E. determination of the small region of the optimal blade axis position of the axial-flow pump under all the operating conditions;

F. determination of the optimal blade axis position of the axial-flow pump under all the operating conditions; and G. comparison of blade hydraulic torques before and after optimization of the blade axis position of the axial-flow pump.

The method of determination of the calculation conditions within the range of all the operating conditions of the axial-flow pump as described in step A is as follows: within the range of the operating head of the axial-flow pump, m equally spaced heads are selected, m=5~10, the minimum operating head $H_{min}$ and the maximum operating head $H_{max}$ are included, a head interval is $$\Delta H = \frac{H_{max} - H_{min}}{m - 1},$$

i.e., m operating heads are $H_1=H_{min}$, $H_2=H_{min}+\Delta H$, . . . $H_{m-1}=H_{max}-\Delta H$, $H_m=H_{max}$: for each of the m heads, n blade angles are selected at certain intervals within the range of operating blade angles of the axial-flow pump, n=5~10, the minimum operating blade angle $\alpha_{min}$ and the maximum operating blade angle $\alpha_{max}$ are included, i.e., $\alpha_1=\alpha_{min}$, $\alpha_2$, . . . , $\alpha_{n-1}$, $\alpha_n=\alpha_{max}$, thus determining m×n calculation conditions.

The method of determination of the calculation area of the flow field of the axial-flow pump as described in step B is as follows: as shown in FIG. 1, the calculation area of the flow field of the axial-flow pump is determined, including a straight section with a length about 1 time the impeller diameter before the impeller inlet, an impeller section, a guide vane section, and a straight section with a length of 1~2 times the impeller diameter after the guide vane outlet. Gambit software is used for modeling and mesh generation of axial-flow bodies in the front and rear extension sections, TurboGrid software is used for modeling and mesh generation of the water bodies in the impeller and the guide vane, and three-dimensional modeling is conducted on the calculation area of the flow field of the axial-flow pump at total n impeller blade angles, i.e., $\alpha_1$, $\alpha_2$, . . . , $\alpha_{n-1}$, $\alpha_n$.

The method of numerical simulation of the flow field of the axial-flow pump and calculation and determination of the blade hydraulic torque as described in step C is as follows:

the flow control equations, the continuity equation is:

$$\frac{\partial \rho}{\partial t} + \nabla \bullet (\rho U) = 0 \tag{1}$$

the momentum equation is:

$$\frac{\partial \rho U}{\partial t} + \nabla \bullet (\rho U \otimes U) - \nabla \bullet (\mu_{eff} \nabla U) = \nabla \bullet p' + \nabla \bullet (\mu_{eff} \nabla U)^T + B \tag{2}$$

wherein ρ-density of water body; t-time; U-velocity vector; B-sum of volume forces; $\mu_{eff}$-effective viscosity; p-correction pressure; ∇-divergence; ⊚-vector product; ⊗-multiplication cross, and T-transposition; wherein $$\mu_{eff} = \mu + \mu_t \tag{3}$$

$$p' = p + \frac{2}{3}\rho k \tag{4}$$

wherein μ-viscosity of water body; $\mu_t$-turbulent viscosity; p-pressure; k-turbulent kinetic energy; a k-ε turbulence model assumes that turbulence viscosity is related to turbulent kinetic energy and turbulent kinetic energy dissipation, i.e., $$\mu_t = C_\mu \rho \frac{k^2}{\varepsilon} \tag{5}$$

wherein ε-turbulent kinetic energy dissipation rate; and $C_\mu$-k-ε turbulence model constant.

The following k-ε turbulence models are adopted:

$$\frac{\partial(\rho k)}{\partial t} + \nabla \bullet (\rho U k) = \nabla \bullet \left[\left(\mu + \frac{\mu_t}{\sigma_k}\right)\nabla k\right] + P_k - \rho\varepsilon \tag{6}$$

$$\frac{\partial(\rho \varepsilon)}{\partial t} + \nabla \bullet (\rho U \varepsilon) = \nabla \bullet \left[\left(\mu + \frac{\mu_t}{\sigma_\varepsilon}\right)\nabla_\varepsilon\right] + \frac{\varepsilon}{k}(C_{\varepsilon_1} P_k - C_{\varepsilon_2}\rho\varepsilon) \tag{7}$$

wherein $C_{\varepsilon_1}$, $C_{\varepsilon_2}$, $\sigma_k$, $\sigma_\varepsilon$-constants; and $P_k$-turbulent shear output term.

Boundary conditions: pressure inlet boundary conditions and mass flow outlet boundary conditions are adopted in the calculation area of the flow field of the axial-flow pump.

CFX fluid calculation software is used for numerical simulation of the calculation area of the flow field of the axial-flow pump under m×n calculation conditions in step A, so as to obtain the blade hydraulic torque under each calculation condition at different heads and different blade angles, which is listed in table 1.

TABLE 1

Blade hydraulic torque (Unit: N · m) of water pump under each calculation condition before optimization of blade axis position

| α | $H_1$ | $H_2$ | . . . | $H_{m-1}$ | $H_m$ |
|---|---|---|---|---|---|
| $\alpha_1$ | | | | | |
| $\alpha_2$ | | | | | |
| . . . | | | | | |
| $\alpha_{n-1}$ | | | | | |
| $\alpha_n$ | | | | | |

The method of determination of the range of the position of the blade resultant hydraulic pressure action line of the axial-flow pump and the optimal blade axis position under all the operating conditions as described in step D is as follows: according to the blade hydraulic torque (the torque of hydraulic pressure to a blade axis) and the resultant hydraulic pressure of the axial-flow pump under m×n calculation conditions calculated with CFX fluid calculation software, the distance between the blade resultant hydraulic pressure action line and the current blade axis approximately on a calculation cylindrical surface under m×n calculation conditions of the axial-flow pump is calculated and determined by a formula (8)

$$L = \frac{M}{F_w} \tag{8}$$

wherein L—the distance from the blade resultant hydraulic pressure action line to the current blade axis approximately on a calculation cylindrical surface; M—the hydraulic torque of the blade hydraulic pressure to the current blade axis, calculated with CFD software; $F_W$—the blade resultant hydraulic pressure obtained by combining the axial, circumferential and radial pressures on the blade, calculated with the CFD software (for an axial-flow pump, the radial component of the blade hydraulic pressure is small), and then the optimal blade axis position is located between the two blade resultant hydraulic pressure action lines farthest from each other under all operating conditions, i.e., between the two outermost blade hydraulic pressure action lines in the circumferential direction from inlet to outlet of the blade, as shown in FIG. 2, in which: 1—the calculation cylindrical surface of the blade; 2—the current blade axis position; 3—the resultant force action line closest to the outlet edge of the blade; 4—the resultant force action line closest to the inlet edge of the blade; and s—the range of the optimal blade axis position.

According to the determination of the small region of the optimal blade axis position of the axial-flow pump under all the operating conditions as described in step E, the range width between the two blade resultant hydraulic pressure action lines farthest from each other on the calculation cylindrical surface of the blade is s, the range width s is divided into k equal parts, starting from the action line, closer to the current blade axis, in the two outermost blade resultant hydraulic pressure action lines, blade axes 1, 2, . . . , k−1, k are set at the equal parts to the other end of the range with the width s, and distances between the k blade axes and the resultant action line closest to the current blade axis are set as slk, 2slk, . . . (k−1)slk, s; a coordinate system as shown in FIG. 3 is established, an abscissa represents a distance from the set blade axis position to the current blade axis, and an ordinate represents the maximum hydraulic torque of the blade under all the operating conditions at different blade axis positions; the blade hydraulic torque of the axial-flow pump under m×n calculation conditions when the blade axis is located at the set k blade axis different positions is calculated, the blade hydraulic torque with the largest absolute value of the axial-flow pump under the m×n calculation conditions at each set blade axis position is determined, positions of two set adjacent blade axes $O_1$-$O_1$ and $O_2$-$O_2$ between which an algebraic value of the hydraulic torque with the largest absolute value is positively and negatively converted are found, and then the optimal blade axis position is located between the $O_1$-$O_1$ axis and the $O_2$-$O_2$ axis, further narrowing the range of the optimal blade axis position.

According to the determination of the optimal blade axis position of the axial-flow pump under all the operating conditions as described in step F, as shown in FIG. 3, on the calculation cylindrical surface of the blade, for a region between the two set adjacent blade axes $O_1$-$O_1$ and $O_2$-$O_2$ between which the maximum hydraulic torque of the blade of the axial-flow pump under all the operating conditions is positively and negatively converted, the 0.618 golden section method is conducted to accelerate the fine approximation to the optimal blade axis position so as to minimize the maximum hydraulic torque of the blade of the axial-flow pump under all the operating conditions. If the maximum hydraulic torque under all the operating conditions is positive for the blade axis $O_1$-$O_1$ and the maximum hydraulic torque under all the operating conditions is negative for the blade axis $O_2$-$O_2$, a blade axis $O_3$-$O_3$ is set at a distance of 0.618slk from the axis $O_1$-$O_1$ to the axis $O_2$-$O_2$, and the maximum hydraulic torque of the blade of the axial-flow pump under all the operating conditions for the blade axis $O_3$-$O_3$ is calculated and determined.

If the maximum hydraulic torque of the blade of the axial-flow pump under all the operating conditions for the blade axis $O_3$-$O_3$ is positive, it is indicated that the optimal blade axis is located between the axis $O_3$-$O_3$ and the axis $O_2$-$O_2$, then a blade axis $O_4$-$O_4$ is set at a distance of 0.618×(1~0.618)slk from the axis $O_3$-$O_3$ to the axis $O_2$-$O_2$, and the maximum hydraulic torque of the blade of the axial-flow pump under all the operating conditions for the blade axis $O_4$-$O_4$ is calculated and determined; if the maximum hydraulic torque of the blade of the axial-flow pump under all the operating conditions for the blade axis $O_3$-$O_3$ is negative, a blade axis $O_4$-$O_4$ is set at a distance of 0.618×0.618slk from the axis $O_1$-$O_1$ to the axis $O_3$-$O_3$, and the maximum hydraulic torque of the blade of the axial-flow pump under all the operating conditions for the blade axis $O_4$-$O_4$ is calculated and determined; . . . , continue this way until the distance between the last approaching two adjacent blade axes is small enough to satisfy a formula (9), $$\Delta s \leq 0.001m \quad (9),$$

the blade axis at this position is the optimal blade axis, which can ensure the minimization of the maximum hydraulic torque of the blade of the axial-flow pump under all the operating conditions.

According to comparison of blade hydraulic torques before and after optimization of the blade axis position of the axial-flow pump as described in step G, the blade hydraulic torque after optimization of the blade axis position is calculated and listed in a Table 2. Taking the blade angle as an abscissa and the blade hydraulic torque as an ordinate, the blade hydraulic torques of the axial-flow pump under m×n calculation conditions before and after the optimization of the blade axis position are plotted on a graph, and blade hydraulic torque points at the same head but different angles are connected to compare the blade hydraulic torque before and after the optimization of the blade axis position.

TABLE 2

Blade hydraulic torque (Unit: N · m) of water pump under each calculation condition after optimization of blade axis position

| α | $H_1$ | $H_2$ | . . . | $H_{m-1}$ | $H_m$ |
|---|---|---|---|---|---|
| $\alpha_1$ | | | | | |
| $\alpha_2$ | | | | | |
| . . . | | | | | |
| $\alpha_{n-1}$ | | | | | |
| $\alpha_n$ | | | | | |

Results show that after the optimization of the blade axis position of the axial-flow pump, the maximum absolute hydraulic torque of the blade under all the operating conditions is reduced by about ½, an average absolute hydraulic torque of the blade is reduced by about ¾, and the blade hydraulic torque is greatly reduced.

The invention has the beneficial effects that the method for optimizing the blade axis position of the axial-flow pump under all the operating conditions is a blade axis position optimization determination method capable of minimizing the maximum blade hydraulic torque of the axial-flow pump under all the operating conditions at different heads and different blade angles, and can reduce the blade hydraulic torque and adjustment force on the premise of not changing the hydraulic performance of the impeller. Through the calculation and analysis of the blade hydraulic torque and the adjustment force of the full-adjustable axial-flow pumps and guide vane mixed-flow pumps under all the operating conditions, the blade axis position of the axial-flow pump is optimized, and the blade hydraulic torque of the axial-flow pump under all the operating conditions is greatly reduced, thus reducing the adjustment force. The invention has been put into use and can greatly reduce the adjustment force of a blade adjustment mechanism of the axial-flow pump under all the operating conditions, reduce a blade angle adjustment error, improve the accuracy of operating parameters of the axial-flow pump and the reliability and durability of the adjustment mechanism, and prolong the service life, and can be widely applied to large and medium-sized full-adjustable axial-flow pumps and guide vane mixed-flow pumps which are extensively used, so as to promote the industry progress, thus having important significance.

Figure 3:
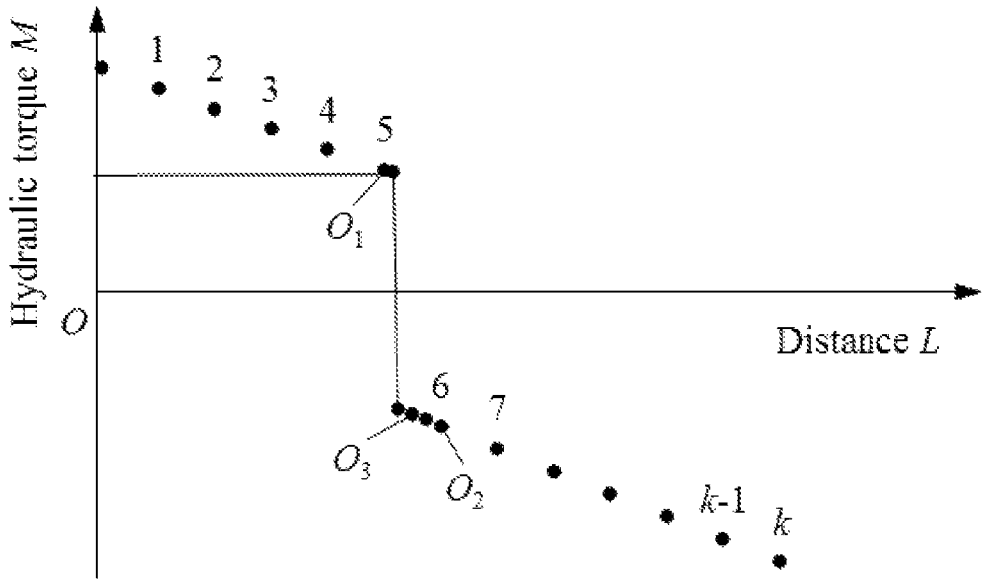

1—blade cross section on a calculation cylindrical surface; 2—current blade axis position; 3—resultant force action line closest to an outlet edge of the blade; 4—resultant force action line closest to an inlet edge of the blade; s—the range which the optimal blade axis position locates in FIG. 3 is a schematic view of the determination of the maximum blade hydraulic torque, the small region of the optimal blade axis position and the optimal blade axis position under all operating conditions at different blade axis positions in the present invention.

Figure 4:
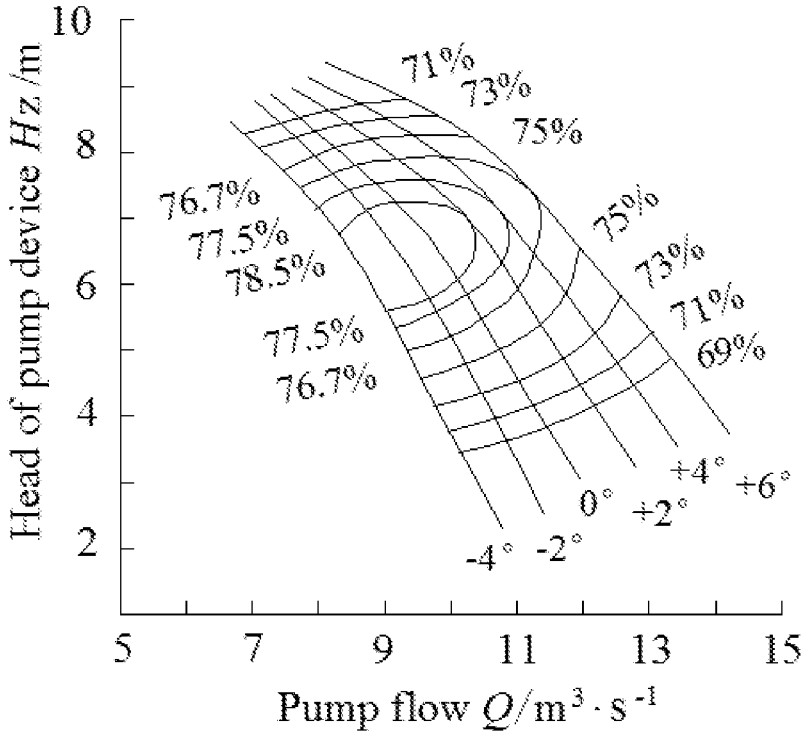

FIG. 4 is a performance graph of a pump device in an embodiment of the present invention.

Figure 5:
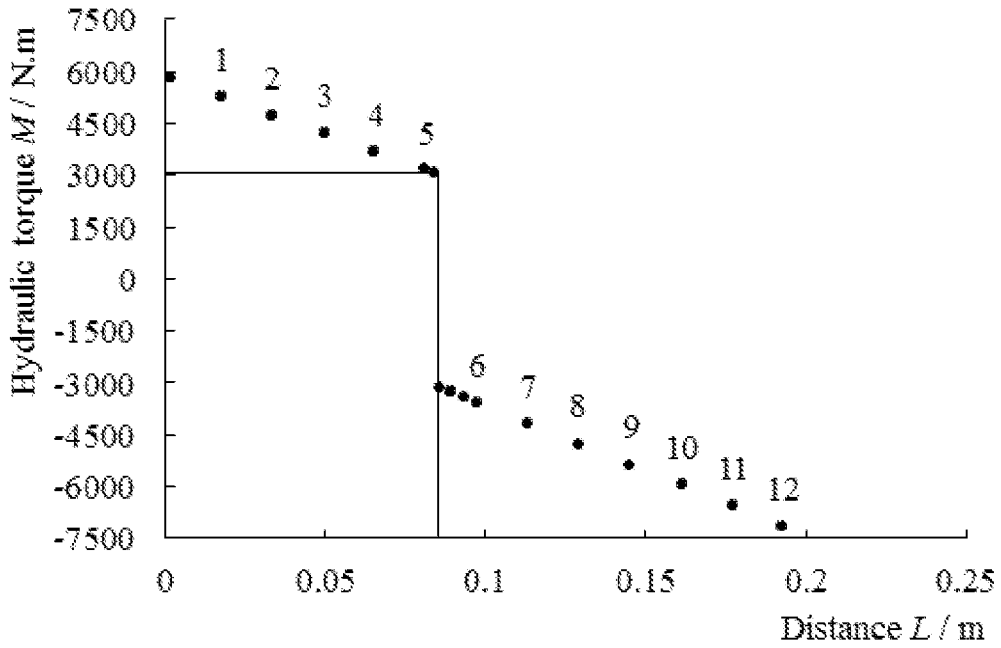

FIG. 5 is a diagram of the determination of the maximum blade hydraulic torque, the small region of an optimal blade axis position and the optimal blade axis position under all the operating conditions at different blade axis positions in an embodiment of the present invention.

Figure 6:
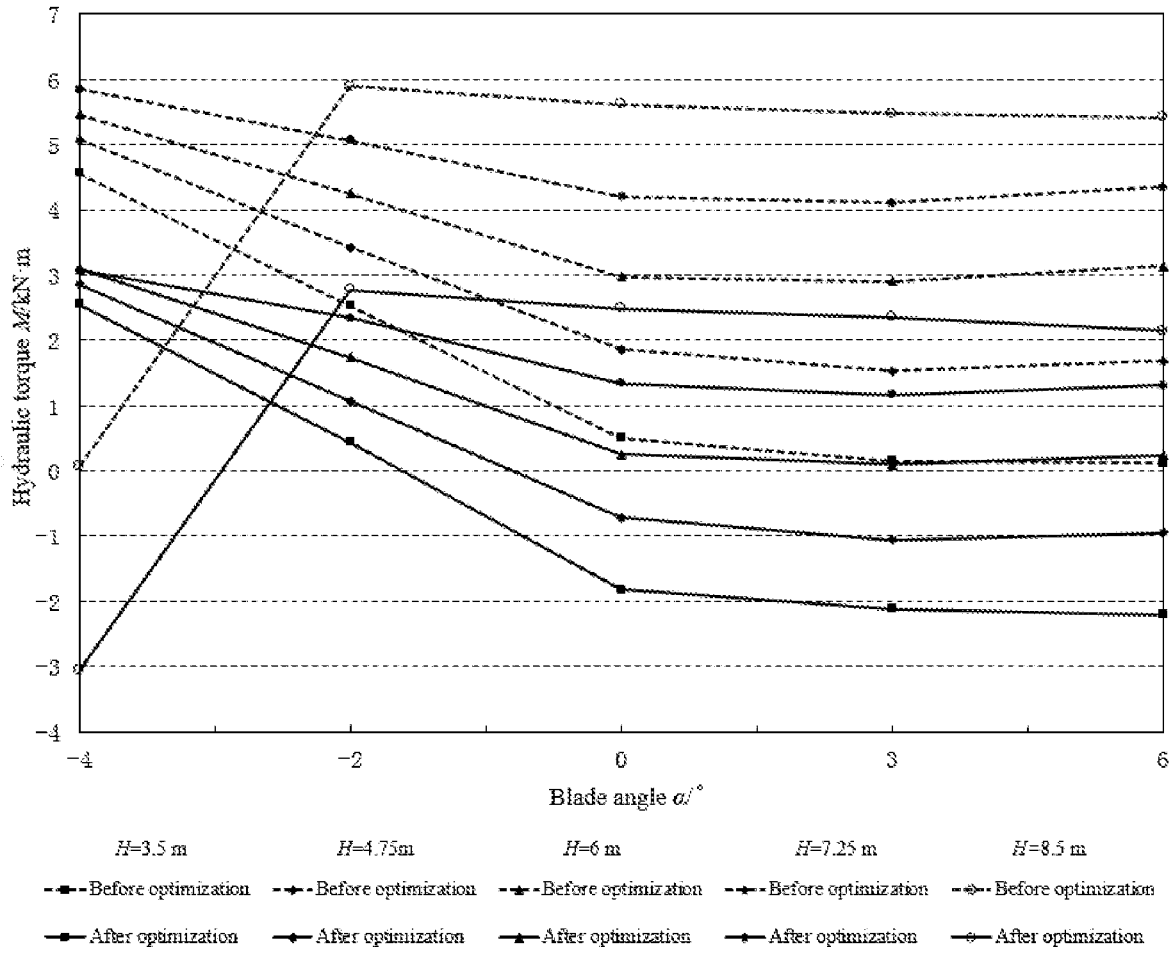

FIG. 6 is an axial-flow pump blade comparison diagram of the blade hydraulic torques under 25 calculation conditions before and after the optimization of the blade axis position in an embodiment of the present invention.

DETAILED DESCRIPTION OF THE INVENTION

The present invention will be further described with reference to the following embodiments.

For a large vertical axial-flow pump in a pumping station, impeller diameter D=1640 mm, impeller hub diameter $d_h$=820 mm, blade design angle is 0°, rotation speed is 250 r/min, design head of a pump device is 6 m, design flow is 10.6 $m^3/s$, and blade angle adjustment range is −4°~+6°. The blade is made of stainless steel, and an impeller and a guide vane structure of the axial-flow pump are known. Performance curves of the pump device are shown in FIG. 4.

A. Determination of calculation conditions within the range of all operating conditions of the axial-flow pump According to the actual operating range of the axial-flow pump, five heads of the pump device: 3.5 m, 4.75 m, 6 m, 7.25 m and 8.5 m, and five blade angles: −4°, −2°, 0°, 3° and 6° are determined, a total of 25 calculation conditions. Through the calculation and analysis of the blade hydraulic torque under the 25 conditions, the blade axis position is optimized to achieve the purpose of reducing the blade hydraulic torque.

Figure 1:
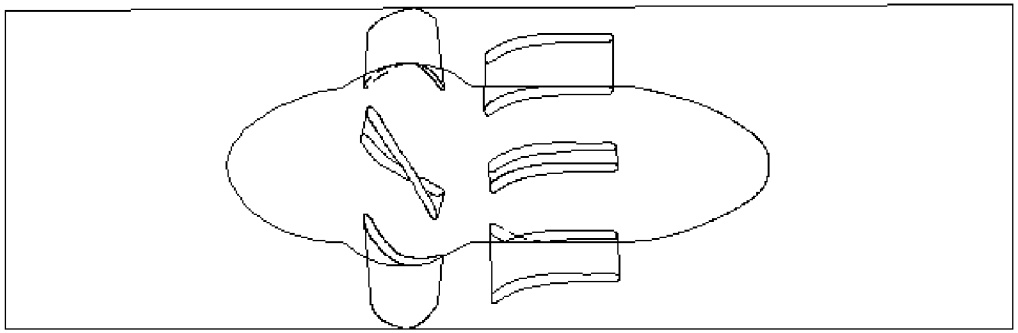
FIG. 1 is a schematic view of the calculation area of the flow field of a axial-flow pump according to the present invention.
Figure 2:
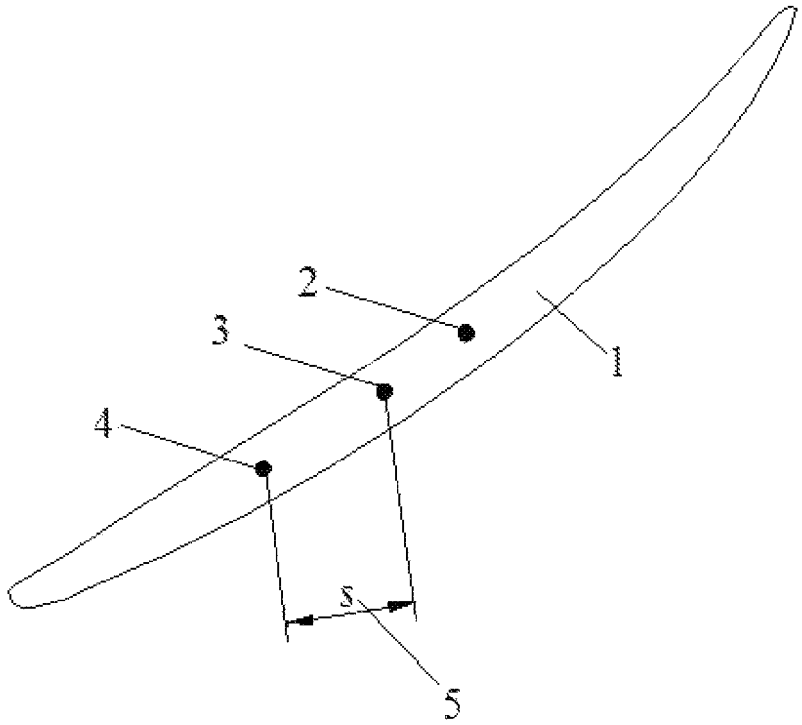
FIG. 2 is a schematic view of the range of an optimal blade axis position in the present invention.

B. Three-dimensional modeling and mesh generation of the calculation area of the flow field of the axial-flow pump This embodiment carries out three-dimensional modeling on the calculation area of the flow field of the axial-flow pump composed of four sections: a section before an impeller inlet, an impeller section, a guide vane body section and a section after the guide vane outlet as shown in FIG. 1, with the number of divided grids being 215280, 338094, 405768 and 464536 respectively, and grid independence verification is also conducted.

C. Numerical simulation of the flow field of the axial-flow pump and calculation and determination of the blade hydraulic torque By using CFX fluid calculation software and a k-c turbulence model, the flow field of the 25 calculation conditions in A is numerically simulated, and the internal flow field of the axial-flow pump, the surface pressure distribution of a blade and the blade hydraulic torque are obtained. The hydraulic torques of the 25 calculation conditions are shown in Table 3.

TABLE 3

Embodiment blade hydraulic torque (Unit: N · m) of water pump under each calculation condition before optimization of blade axis position

| α | H = 3.5 m | H = 4.75 m | H = 6 m | H = 7.25 m | H = 8.5 m |
|---|---|---|---|---|---|
| −4° | 4552.598 | 5076.718 | 5459.788 | 5846.693 | 64.730 |
| −2° | 2528.615 | 3425.948 | 4249.995 | 5061.623 | 5886.203 |
| 0° | 499.408 | 1855.120 | 2974.868 | 4207.868 | 5613.243 |
| 3° | 153.170 | 1523.600 | 2903.540 | 4108.908 | 5473.183 |
| 6° | 122.658 | 1678.430 | 3132.843 | 4347.790 | 5416.093 |

D. Determination of the range of the position of the blade resultant hydraulic pressure action line of the axial-flow pump and the optimal blade axis position under all the operating conditions Taking the operating point where head H=6 m and blade angle α=0° as an example, forces on the blade in axial, circumferential and radial directions is calculated with CFX: the circumferential resultant force on two sides of the blade is 13642.8 N, the radial resultant force on the two sides is 421.185 N, the axial resultant force on the two sides is 29495.1 N, and the blade hydraulic torque is 2974.868 N·m. A force arm L in the blade cross section is calculated to be 0.0915 m according to a formula (8). As shown in FIG. 5, through the calculation of the 25 calculation conditions of the axial-flow pump, blade resultant hydraulic pressure action points are all located on the inlet side of the current blade axis, and the maximum and minimum values of the force arm from the current blade axis are 0.193003 m and 0.001734 m respectively. Then the optimal blade axis is located on the inlet side of the current blade axis, 0.001734-0.193003 m away from the current blade axis.

E. Determination of the small region of the optimal blade axis position of the axial-flow pump under all the operating conditions As shown in FIG. 5, the section 0.001734-0.193003 m away from the current blade axis in the direction of the inlet side of the current blade axis is divided into 12 segments, each with a length of 0.015939 m, and starting from the position 0.001734 m away from the current blade axis, the blade hydraulic torques under the 25 calculation conditions are calculated respectively when the blade axis moves towards the inlet edge of the blade by 1 segment, 2 segments, . . . , 11 segments and 12 segments. In Table 4, the blade hydraulic torques of the first blade axis position (that is, the blade axis 0.0176731 m away from the current blade axis) under the 25 calculation conditions are selected, and the maximum blade hydraulic torque under the 25 calculation conditions at the blade axis position is determined to be 3086.615 N·m. The blade hydraulic torques under the 25 conditions at the 12 blade axis positions are calculated respectively, the blade hydraulic torque with the largest absolute value at each blade axis position is determined for comparison as shown in FIG. 5, it is found that the optimal blade axis position is between the axis 5 with the minimum positive hydraulic torque and the axis 6 with the minimum negative hydraulic torque, and the axis 5 and the axis 6 are 0.081429 m and 0.097368 m away from the current blade axis respectively. In the calculation process, the change in the maximum blade hydraulic torque at each blade axis position is shown in FIG. 5.

TABLE 4

Embodiment blade hydraulic torque (Unit: N · m) under each calculation condition when the blade axis moves towards the inlet edge by 0.0176731 m

| α | H = 3.5 m | H = 4.75 m | H = 6 m | H = 7.25 m | H = 8.5 m |
|---|---|---|---|---|---|
| −4° | 2553.236 | 2857.702 | 3086.615 | 3072.477 | −3066.702 |
| −2° | 441.404 | 1069.245 | 1733.486 | 2346.403 | 2767.815 |
| 0° | −1816.009 | −717.365 | 248.373 | 1337.233 | 2485.496 |
| 3° | −2113.533 | −1061.631 | 90.416 | 1167.468 | 2350.067 |
| 6° | −2203.052 | −956.181 | 242.440 | 1310.406 | 2148.345 |

F. Determination of the optimal blade axis position of the axial-flow pump under all the operating conditions As shown in FIG. 5, in the section 0.081429 m to 0.097368 m away from the current blade axis in the direction of the inlet side of the current blade axis, the 0.618 golden section method is continuously carried out to calculate the optimal blade axis position which nearly minimizes the maximum blade hydraulic torque, and the optimal blade axis position is found to be 0.084 m away from the current blade axis in the direction of the inlet side of the current blade axis, with the error not exceeding 0.001 m.

G. Comparison of blade hydraulic torques before and after optimization of the blade axis position of the axial-flow pump The blade hydraulic torques under 25 calculation conditions after optimization of the blade axis position are shown in Table 5. As shown in Table 3, Table 5 and FIG. 6, the blade hydraulic torques under the 25 calculation conditions before and after optimization of the blade axis position are comprehensively compared. Compared with the values before optimization of the blade axis position, the maximum blade hydraulic torque under all the conditions is reduced to 3072.48 N·m from original 5886.20 N·m after optimization, a decrease of 47.80%. In all the calculation conditions, only the conditions with head H=3.5 m and blade angle α=0°, 3° and 6° as well as the condition with head H=8.5 m and blade angle α=−4° see a slight increase in blade hydraulic torque, the blade hydraulic torque under the rest of the conditions is greatly reduced, with the absolute value of the average blade hydraulic torque under 25 calculation conditions reduced from 3446.548 N·m to 774.97 N·m, a decrease of 77.51%, and the blade hydraulic torque reduction effect is significant.

TABLE 5

Embodiment blade hydraulic torque (Unit: N · m) of water pump under each calculation condition after optimization of blade axis position

| α | H = 3.5 m | H = 4.75 m | H = 6 m | H = 7.25 m | H = 8.5 m |
|---|---|---|---|---|---|
| −4° | 2553.236 | 2857.702 | 3086.615 | 3072.477 | −3066.702 |
| −2° | 441.404 | 1069.245 | 1733.486 | 2346.403 | 2767.815 |
| 0° | −1816.009 | −717.365 | 248.373 | 1337.233 | 2485.496 |
| 3° | −2113.533 | −1061.631 | 90.416 | 1167.468 | 2350.067 |
| 6° | −2203.052 | −956.181 | 242.440 | 1310.406 | 2148.345 |

What is claimed is:

1. A method for making an axial-flow pump blade with an optimal blade axis position and the smallest blade hydraulic torque under all operating conditions, characterized by comprising the following operation steps:

A. determination of calculation conditions within a range of all the operating conditions of an axial-flow pump as follows: an operating head range of the axial-flow pump, m equally spaced heads are selected, m=5~10, a minimum operating head $H_{min}$ and a maximum operating head $H_{max}$ are included, the head interval is $$\Delta H = \frac{H_{max} - H_{min}}{m - 1},$$

for each of the m heads, n blade angles are selected at certain intervals within the operating blade angle range of the axial-flow pump, n=5~10, a minimum operating blade angle $\alpha_{min}$ and a maximum operating blade angle $\alpha_{max}$ are included, and determining m×n calculation conditions;

B. three-dimensional modeling and mesh generation of a calculation area of a flow field of the axial-flow pump includes a straight section with a length about 1 time an impeller diameter in front of an impeller inlet, an impeller section, a guide vane body section, and a straight section with a length of 1~2 times the impeller diameter behind a guide vane body outlet, and three-dimensional modeling and mesh generation are conducted on the calculation area of the flow field of the axial-flow pump at total n impeller blade angles;

C. numerical simulation of the flow field of the axial-flow pump and calculation and determination of blade hydraulic torque as follows: a water-mass continuity equation, a momentum equation and k-B turbulence models are adopted, pressure inlet boundary conditions and mass flow outlet boundary conditions are adopted in the calculation area of the flow field of the axial-flow pump, and CFX fluid calculation software is used for numerical simulation of the calculation area of the flow field of the axial-flow pump under the m×n calculation conditions, so as to obtain the blade hydraulic torques at different heads and different blade angles, which are listed in a table;

D. determination of a range of a position of a blade resultant hydraulic pressure action line of the axial-flow pump and the optimal blade axis position under all the operating conditions as follows:

according to the blade hydraulic torque and the resultant hydraulic pressure of the axial-flow pump under m×n calculation conditions calculated in steps A-C, the distance between the blade resultant hydraulic pressure action line and the current blade axis approximately on a calculation cylindrical surface under the m×n calculation conditions of the axial-flow pump is $$L = \frac{M}{F_w}, \tag{1}$$

wherein L—the distance from the blade resultant hydraulic pressure action line to the current blade axis; M—the blade hydraulic torque; $F_W$—the blade resultant hydraulic pressure, and then the optimal blade axis position is located between two blade resultant hydraulic pressure action lines farthest from each other in all the operating conditions;

E. determination of a small region of the optimal blade axis position of the axial-flow pump under all the operating conditions includes a range width between the two blade resultant hydraulic pressure action lines farthest from each other approximately on a calculation cylindrical surface is s, the range width s is divided into k equal parts, starting from the action line closer to the current blade axis, in the two blade resultant hydraulic pressure action lines farthest from each other, blade axes 1, 2, . . . , k−1, k are set at the equal parts to the other end of the range with the width s, and distances between the k blade axes and the starting resultant action line are set as slk, 2slk, (k−1)slk, s respectively; a coordinate system is established, an abscissa represents a distance from the set blade axis position to the current blade axis, and an ordinate represents a maximum hydraulic torque of a blade under all the operating conditions at different blade axis positions; the blade hydraulic torques of the axial-flow pump under m×n calculation conditions when the blade axis is located at the set k different blade axis positions are calculated, the blade hydraulic torque with the largest absolute value of the axial-flow pump under the m×n calculation conditions at each set blade axis position is determined, positions of two set adjacent blade axes $O_1$-$O_1$ and $O_2$-$O_2$ in which an algebraic value of the hydraulic torque with the largest absolute value is positively and negatively converted are found, and then the optimal blade axis position is located in the small region between the $O_1$-$O_1$ axis and the $O_2$-$O_2$ axis, further narrowing the range of the optimal blade axis position;

F. determination of the optimal blade axis position of the axial-flow pump under all the operating conditions includes on a calculation cylindrical surface in the blade, for the small region between the two set adjacent blade axes $O_1$-$O_1$ and $O_2$-$O_2$ in which the maximum hydraulic torque of the blade of the axial-flow pump under all the operating conditions is positively and negatively converted, a 0.618 golden section method is conducted to accelerate the fine approximation to the optimal blade axis position so as to minimize the maximum hydraulic torque of the blade of the axial-flow pump under all the operating conditions; if the maximum hydraulic torque under all the operating conditions is positive for the blade axis $O_1$-$O_1$ and the maximum hydraulic torque under all the operating conditions is negative for the blade axis $O_2$-$O_2$, a blade axis $O_3$-$O_3$ is set at a distance of 0.618slk from the axis $O_1$-$O_1$ to the axis $O_2$-$O_2$, and the maximum hydraulic torque of the blade of the axial-flow pump under all the operating conditions for the blade axis $O_3$-$O_3$ is calculated and determined; if the maximum hydraulic torque of the blade of the axial-flow pump under all the operating conditions for the blade axis $O_3$-$O_3$ is positive, it is indicated that the optimal blade axis is located between the axis $O_3$-$O_3$ and the axis $O_2$-$O_2$, then a blade axis $O_4$-$O_4$ is set at a distance of 0.618×(1−0.618) slk from the axis $O_3$-$O_3$ to the axis $O_2$-$O_2$, and the maximum hydraulic torque of the blade of the axial-flow pump under all the operating conditions for the blade axis $O_4$-$O_4$ is calculated and determined; if the maximum hydraulic torque of the blade of the axial-flow pump under all the operating conditions for the blade axis $O_3$-$O_3$ is negative, a blade axis $O_4$-$O_4$ is set at a distance of 0.618×0.618slk from the axis $O_1$-$O_1$ to the axis $O_3$-$O_3$, and the maximum hydraulic torque of the blade of the axial-flow pump under all the operating conditions for the blade axis $O_4$-$O_4$ is calculated and determined; repeat these steps, continue this way until a distance Δs between the last approaching two adjacent blade axes is small enough to satisfy a formula (2), $$\Delta s \leq 0.001m \tag{2}$$

the blade axis at this position is the optimal blade axis, which can ensure the minimization of the maximum hydraulic torque of the blade of the axial-flow pump under all the operating conditions;

G. comparison of blade hydraulic torques before and after optimization of the blade axis position of the axial-flow pump includes the blade hydraulic torque under each calculation condition after optimization of the blade axis position is calculated and listed in a blade hydraulic torque table after the optimization of the blade axis position; by taking a blade angle as an abscissa and the blade hydraulic torque as an ordinate, the blade hydraulic torques of the axial-flow pump under m×n calculation conditions before and after the optimization of the blade axis position are plotted on a graph, and blade hydraulic torque points at the same head but different angles are connected to compare the blade hydraulic torques before and after the optimization of the blade axis position; and results show that after the optimization of the blade axis position of the axial-flow pump, the maximum absolute hydraulic torque of the blade under all the operating conditions is reduced by 45%~50%, and the average absolute hydraulic torque of the blade is reduced by 75%~80%; and H. creating the axial-flow pump blade with the optimal blade axis position and the smallest blade hydraulic torque under all operating conditions according to step A to step H.

* * * * *